US006762678B2

(12) United States Patent
Arens

(10) Patent No.: US 6,762,678 B2
(45) Date of Patent: Jul. 13, 2004

(54) SCUBA DRIVER COMMUNICATION AND TRACKING DEVICE

(76) Inventor: Susanne Arens, 6854 Oak Valley Dr., Colorado Springs, CO (US) 80919

( * ) Notice: Subject to any disclaimer, the term of this patent is extended or adjusted under 35 U.S.C. 154(b) by 135 days.

(21) Appl. No.: 10/131,061

(22) Filed: Apr. 24, 2002

(65) Prior Publication Data

US 2002/0109601 A1 Aug. 15, 2002

Related U.S. Application Data

(63) Continuation-in-part of application No. 09/604,522, filed on Jun. 27, 2000.

(51) Int. Cl.[7] ..... G08B 29/00

(52) U.S. Cl. ..... 340/506; 340/539.13; 340/539.23; 340/573.1; 367/131

(58) Field of Search ..... 340/506, 539.13, 340/539.21, 539.23, 573.1; 367/137, 131, 133, 134, 118, 124

(56) References Cited

U.S. PATENT DOCUMENTS

| | | | | |
|---|---|---|---|---|
| 4,785,291 A | | 11/1988 | Hawthorne | |
| 5,010,529 A | | 4/1991 | Maynus | |
| 5,077,703 A | | 12/1991 | Strauss | |
| 5,119,072 A | | 6/1992 | Hemingway | |
| 5,121,366 A | | 6/1992 | Wayner | |
| 5,170,172 A | | 12/1992 | Weinstein | |
| 5,185,725 A | | 2/1993 | Kent et al. | |
| 5,331,602 A | * | 7/1994 | McLaren | 367/6 |
| 5,428,439 A | | 6/1995 | Parker et al. | |
| 5,523,982 A | * | 6/1996 | Dale | 367/131 |
| 5,570,323 A | | 10/1996 | Prichard et al. | |
| 5,578,933 A | | 11/1996 | Nonaka | |
| 5,652,569 A | | 7/1997 | Gerstenberger et al. | |
| 5,661,460 A | | 8/1997 | Sallen et al. | |
| 5,701,276 A | | 12/1997 | Bellini | |
| 5,714,932 A | | 2/1998 | Castellon et al. | |
| 5,784,339 A | | 7/1998 | Woodsum et al. | |
| 5,812,056 A | | 9/1998 | Law | |
| 5,841,352 A | | 11/1998 | Prakash | |
| 5,900,817 A | | 5/1999 | Olmassakian | |
| 6,029,515 A | | 2/2000 | Lahteenmaki | |
| 6,075,443 A | | 6/2000 | Schepps et al. | |
| 6,084,517 A | | 7/2000 | Rabanne et al. | |
| 6,108,272 A | | 8/2000 | Fox | |
| 6,125,080 A | | 9/2000 | Sonnenschein et al. | |
| 6,127,931 A | | 10/2000 | Mohr | |
| 6,198,390 B1 | | 3/2001 | Schlager et al. | |
| 6,272,072 B1 | | 8/2001 | Wulich et al. | |
| 6,272,073 B1 | | 8/2001 | Doucette et al. | |
| 6,327,220 B1 | | 12/2001 | Miller, Jr. et al. | |

* cited by examiner

*Primary Examiner*—Toan N. Pham
(74) *Attorney, Agent, or Firm*—Kent A. Lembke; Hogan & Hartson LLP

(57) ABSTRACT

A multi-functional underwater device for use by scuba divers for communicating with and tracking the relative direction of one or more other divers. The device is configured to monitor and communicate with multiple other devices simultaneously and includes a transmitter and receiver assembly for transmitting location signals to and receiving location signals from other communication devices on frequencies defined by a communication channel setting for the device. A processor processes signals to determine separation distance between the devices and to compare separation distances to a safety distance. A display assembly indicates communication channel and safety distance for the communication device and indicates when the separation distance is exceeded. The display assembly includes an input portion operable to set the safety distance and/or the communication channel. The transmitter and receiver assembly transmits and receives communication signals, such as check diver and emergency signals, at frequencies defined by the communication channel.

52 Claims, 13 Drawing Sheets

SCUBA DRIVER COMMUNICATION AND TRACKING DEVICE

CROSS REFERENCE TO RELATED PATENT APPLICATIONS

This application is a continuation-in-part of application Ser. No. 09/604,522, filed Jun. 27, 2000, for "System for Alerting When Separated by a Preset Distance," the disclosure of which is herein specifically incorporated by this reference.

BACKGROUND OF THE INVENTION

1. Field of the Invention

The present invention relates in general to underwater location and communication technology, and more particularly to, a multi-function scuba diver communication device for use by dive partners and dive masters for locating divers, for communicating with divers within dive groups with check diver and alert signals, and for automatically alarming when divers become separated by more than a selectable safety distance.

2. Relevant Background

While underwater, it is very important for divers to keep track of each other. One of the most important rules for scuba divers is to, "always know where your dive buddy is". Because of all the equipment, i.e. mask, snorkel, BCD and tank, scuba divers wear, it is very difficult for them to keep their dive buddy in sight. Scuba diving is an exciting, yet dangerous, sport. Divers can find themselves in several life threatening situations. They can encounter predators or get tangled up in seaweed, wrecks, or amongst their own equipment. It is not uncommon for divers to run out of air or get caught in an undertow. All of these situations can be deadly without the assistance of their dive buddies. Since divers cannot speak to each other underwater, it is often difficult or impossible for a diver to attract the attention of another diver.

Communicating between divers, such as between divers and a dive master or between dive partners, is a serious problem that has not been adequately addressed by current diving devices. Communications are made more difficult by the nature of the environment itself in that most forms of communication depend upon the transmission of light or electromagnetic energy through the surrounding water. Light and electromagnetic energy, however, do not propagate well or consistently through water. Light and electromagnetic energy are rapidly attenuated in water even in optimum conditions, usually within a few feet or even inches, and light is additionally blocked by dissolved or particulate matter in the water. Water varies significantly from location to location and even based on dive depths. Water typically does not provide a uniform acoustic transmission medium as the speed of sound propagation and other signal transmission characteristics vary with water temperature, salinity, and depth (or pressure) each of which may vary with dive location. The inhomogeneous nature of sound propagation in water thereby causes time varying variations in the transmission time between a transmitting unit and a receiving unit, even within a single layer. Therefore, the transmission time between a transmitting unit and a receiving unit vary with the location of a dive (i.e., based on the water chemical makeup) and sometimes even with a planned depth for a dive. These complex variances for the behavior of signals make communication difficult as communication techniques may be effective under certain conditions but prove very ineffective under differing dive and water conditions.

Hence, there remains a need for communication devices, systems, and methods that make it easier for divers to keep track of their fellow divers and to attract their attention when needed during a dive. Such devices, systems, and methods preferably would be adapted for use in varying dive locations and under different water conditions and would be readily adapted for use with multiple divers and dive groups of varying skills and experience.

SUMMARY OF THE INVENTION

The present invention addresses the need for underwater communications between dive partners and also between a dive master and divers in dive groups by providing a diver communication device worn or held by divers or attached to a diver buoyancy control device (BCD). The diver communication device includes transmitters, receivers, displays, controls, and data processors and software that enable it to provide a unique combination of communication and diver location functions not available in prior diving equipment. For example, the diver communication device allows two dive partners each using the device to set a dive separation or safety distance between the divers that is monitored by the device on an ongoing basis during the dive and when exceeded, the devices transmit alert signals and an audible, vibratory, and visible signal is provided to both diver communication devices. A tracking device with a display (such as a red, yellow, and green bar graph or light system or directional arrows) is included in each device to enable divers to determine the direction of each other. Diver communications are provided by the inclusion of a "check diver" function in which a signal can be sent by one diver to one or more divers in their group (i.e., operating on the same frequency or frequencies and using a single diver separation distance) and again an audible, vibratory, and visible display is provided to communicate the receipt of a check diver signal to the other diver or divers. Further, the diver communication device includes a manual "panic" function that allows a diver to manually transmit a panic or emergency signal to a dive partner(s) and/or dive master (e.g., a dive leader).

Because the experience and skill of divers varies and because dive conditions vary, the diver communication device is preferably adapted to allow the safety distance or separation range to be set for each set of dive partners and/or for each dive group (2 or more divers operating with a single safety range and communicating on one or more communication frequencies or settings assigned to that group of diver communication devices). For example, a safety distance may be set at 5 feet for unskilled divers or for dangerous conditions while a fifty-foot, hundred-foot, two hundred-foot, and often higher safety range may be set for skilled divers or relatively safe diving conditions. In one embodiment, each diver communication device is configured to support a plurality of safety ranges (such as 6 to 8 ranges (e.g., set at 10, 20, 30, 50, 100, 250 and the like) or more ranges to provide a wider range of operation).

In one embodiment, a special form of diver communication device is provided for use by a dive master in communicating not just with one diver or dive group but also with multiple dive groups. Generally, the dive master communication device includes receivers and transmitters that enable it to transmit and receive at one or more frequencies utilized by each dive group (i.e., each diver communication device used by a diver assigned to a dive group). The dive master communication device can be operated to monitor separation of the divers in each of the dive groups from the dive master communication device to determine whether the divers are within a safety distance perimeter (or sphere) relative to the dive master. An alert can be automatically or manually transmitted to and from the dive master when the distance is exceeded. The dive master and divers can further communicate by the use of check diver-manual alert signals as discussed for diver communication devices used by dive partners. Typically, a check diver-manual alert signal would be transmitted by a dive master to all of the divers within a group concurrently (such as on a single frequency or multiple signals at multiple frequencies), and likewise, a check diver-manual alert signal transmitted by a diver within a group using their diver communication device would be received by the dive master communication device and by the divers within that diver's dive group using their diver communication devices.

More particularly, a communication device is provided for use underwater by a diver for communicating with and tracking the location of one or more other divers. The device includes a transmitter and receiver assembly with signal generators, transmitters, and receivers useful for transmitting location signals to and receiving location signals from another one of the communication devices. Significantly, the location signals are transmitted and received on a frequency or frequencies defined by a communication channel setting for the device which allows other divers using other ones of the devices set at a different communication channel to also be able to communicate without interference. A data processor or processing system and devices (such as a CPU and memory along with useful software and/or firmware) is included to process the received signals to determine a separation distance between the two devices and to compare the separation distance to a safety distance. A display and control assembly is also included with a display for indicating the communication channel and the safety distance presently set for the communication device and for indicating (such as with a light, an acoustic signal, with vibrations, and/or with a text message) that the separation distance has been exceeded.

In one embodiment, the display and control assembly includes an input portion, keys, or buttons that are operable by the operator or diver to set the safety distance and/or the communication channel. According to an important feature of the invention the transmitter and receiver assembly is further adapted for transmitting and receiving communication signals, such as check diver and panic or emergency signals. The frequencies used for these signals are also defined by the communication channel such that other divers not in the dive group of the communication device and the other device do not interfere with these devices' communications. The data processor processes the incoming communication signals to determine the type of signal and to operate the display and control assembly to indicate the receipt of the signal. In one embodiment, a text message is provided that indicates the type of it message received, such as "Check Diver" or "Emergency." To allow a diver to send these signals manually, the display and control assembly includes transmit panic and check diver buttons or keys which when depressed or selected initiate the generation and transmittal of the corresponding message to other devices operating on the communication channel. The display and control assembly may further include a direction indicator to allow a diver to determine the direction of one or more divers. To this end, the transmitter and receiver assembly preferably includes a homing beacon transmitter and receiver for transmitting and receiving a direction signal typically on a different frequency then used for the location signals and the processor operates to determine a direction of the transmitting device for the received signal and operating the display and control assembly to indicate the direction of the transmitting device (such as with red, yellow, and green lights or other direction indicting displays).

According to principles of the present invention, a distance is discovered between a first device and a second device. The discovered distance is compared to a preset distance condition. An alarm is activated when the distance condition is met by the discovered distance or when activated by a user. According to further principals of the present invention, the distance is discovered by any method. One method for discovering the distance is by generating a signal from the first device to the second device and measuring the amplitude of the signal received by the second device then discovering the distance from the measured amplitude of the signal. A second method for determining the distance is by discovering the location of each device and communicating the location of the first device to the second device where the two locations are compared to realize the difference between the two devices. A third method for determining the distance is by the second device requesting a response from the first device and measuring the time between the request and the receipt of the response. The distance is then discovered from the measured time.

DETAILED DESCRIPTION OF THE PREFERRED EMBODIMENTS

The present invention provides a diver communication system of diver communication devices (and, in some embodiments, a dive master communication device) and methods of operating such a communication system. The diver communication system and method is particularly apt at enabling communication in varying water conditions by providing for selectable separation distances between dive partners wearing or using the diver communication devices or a dive master and by calling for unique calibration of each device for the water in the dive area and/or for the anticipated dive depth. Additionally, the diver communication system and method is useful for allowing multiple dive groups diving within a single dive area to communicate with each other without causing communication problems. Briefly, this is achieved through the use of designated communication channels (e.g., frequencies) for location signals and diver communication signals (i.e., manual panics or alerts, manual diver check signals, automatic separation distance exceeded alerts, and diver direction signals). In one embodiment, each diver communication device is configured for monitoring a plurality of safety or separation distances and a plurality of communication frequencies to allow the selection of different separation distances and the use of the devices for multiple dive groups without modifications. In one system and method, a dive master communication device is provided for concurrent monitoring of multiple dive groups (with differing separation distances and communication channels or frequencies) and for communicating with one or more of the dive groups.

The following discussion begins with a specific discussion of the components of the diver communication devices that enable the determination of the distance between two or more diver communication devices with reference to FIGS. 1–8. This discussion includes an explanation of the use of preset separation distances and the automatic transmission of alert signals when the determined distance between two devices exceeds the preset separation distance for the two devices. An important aspect of the invention is the combining of multiple functions in a single diver communication device and how the unique combination of these functions facilitates effective communication between diving partners and, significantly, between 3 or more divers within a dive group (even when diving in proximity to other dive groups) and between a dive master and divers in multiple dive groups. Hence, after the discussion of determining separation distances and transmitting separation alerts, a description of a specific embodiment of a diver communication device is provided with discussion of each of the communication features provided in the device with reference to FIGS. 9 and 10. The resulting communication methods during dives is then discussed more fully with reference to FIGS. 11A, 11B, and 12.

Figure 1:
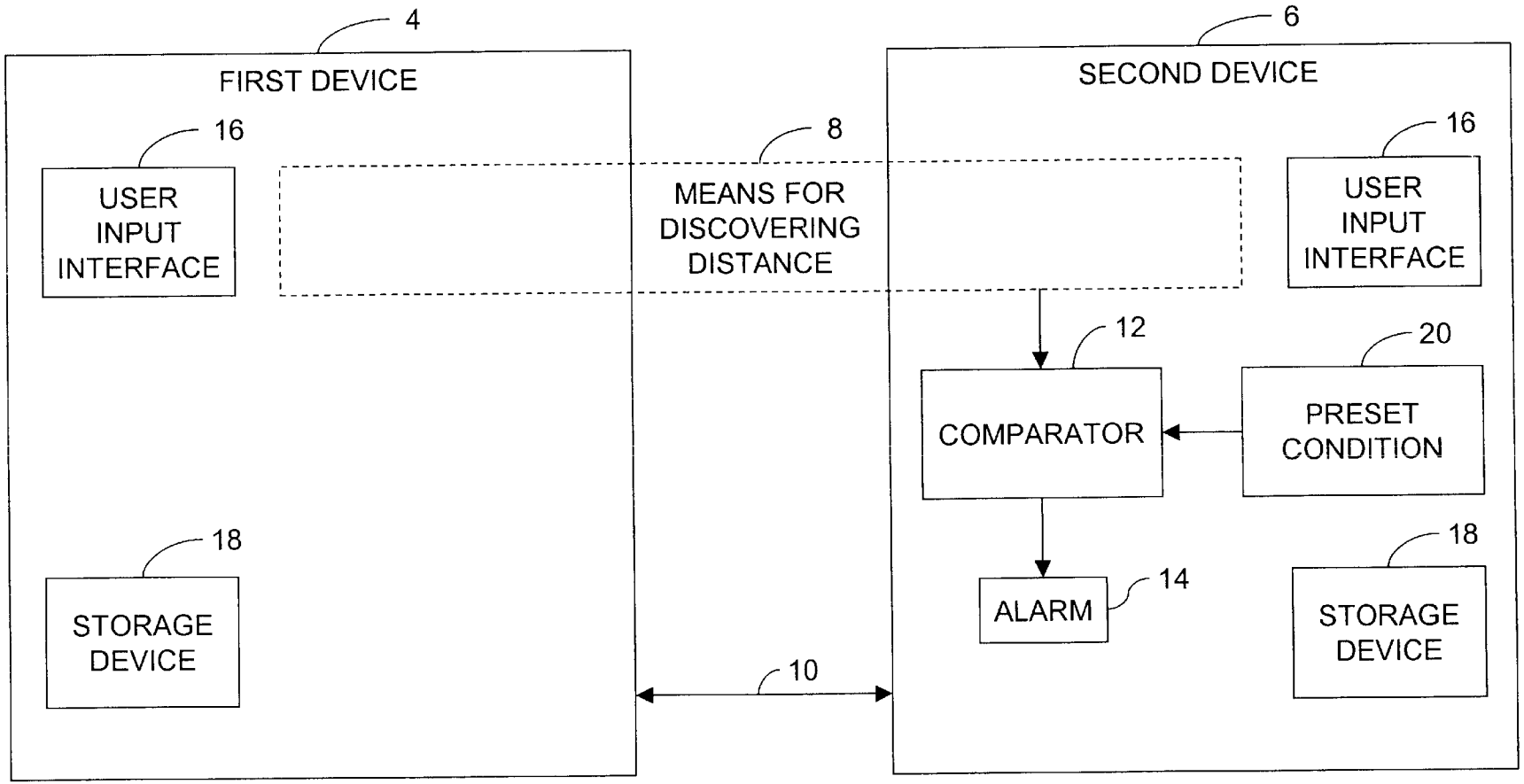
FIG. 1 is a block diagram generally illustrating the system of the present invention.

FIG. 1 illustrates a system 2 for alerting when a first device 4 and a second device 6 are separated by a preset distance. System 2 includes a means 8 for discovering a distance 10 between first device 4 and a second device 6, a comparator 12, and an alarm 14. System 2 may also include various additions such as a user input interface 16 and a storage device 18 for storing a preset distance condition 20 or executable instructions.

First device 4 and second device 6 may be of any shape or design. System 2 may have a variety of uses with each use having its own desired shape. For use in diving, first device 2 and second device 6 are conveniently embodied in a shape to be worn on a diver's wrist or attached to the divers Buoyancy Control Device (BCD). Additionally, when used by divers, it may be desirable for first device 4 and second device 6 to include conventional diving features such as a dive time indicator or other indicators useful for divers.

For clarity, first device 4 and second device 6 are being described as separate devices. In one embodiment of system 2, first device 4 and second device 6 each include all of the components of the other device. In that embodiment, each of two or more divers would be able to keep track of the distance between them.

Comparator 12 is any combination of circuitry and executable instructions able to carry out the function of comparing distance 10 to preset condition 20. As the information describing distance 10 may take a variety of forms, comparator 12 may also be embodied in a variety of ways. For example, if distance 10 is defined within second device 6 as an amplitude, comparator 12 may take the form of an amplitude switch. Alternatively, if distance 10 is defined within second device 6 as a numerical value, comparator 12 may take the form of a processor.

Alarm 14 is any device for alerting a person. For example, alarm 14 may be any type of indication such as an audible, visible, or vibrating alarm.

User input interface 16 is any interface by which a user may interact with either first device 4 or second device 6. For example, user input interface 16 may be one or more buttons, knobs, dials, or switches. User interface 16 may be used to set preset condition 20 or various other settings within first device 4 and second device 6.

Storage device 18 may be any type of storage device such as magnetic, electronic, or optical. Executable instructions stored in storage device 18 may be any instructions for use by first device 4 or second device 6. For example, the executable instructions may be instructions may be instructions for carrying out the method steps of the present invention method.

Preset condition 20 is any condition that includes as one of its components the distance 10 between first device 4 and second device 6. For example, preset condition 20 may be met by any distance 10 over 25 feet. Preset condition 20 may also include other components whereby distance 10 is varied according to, for example, the time or depth of the dive.

Figure 3:
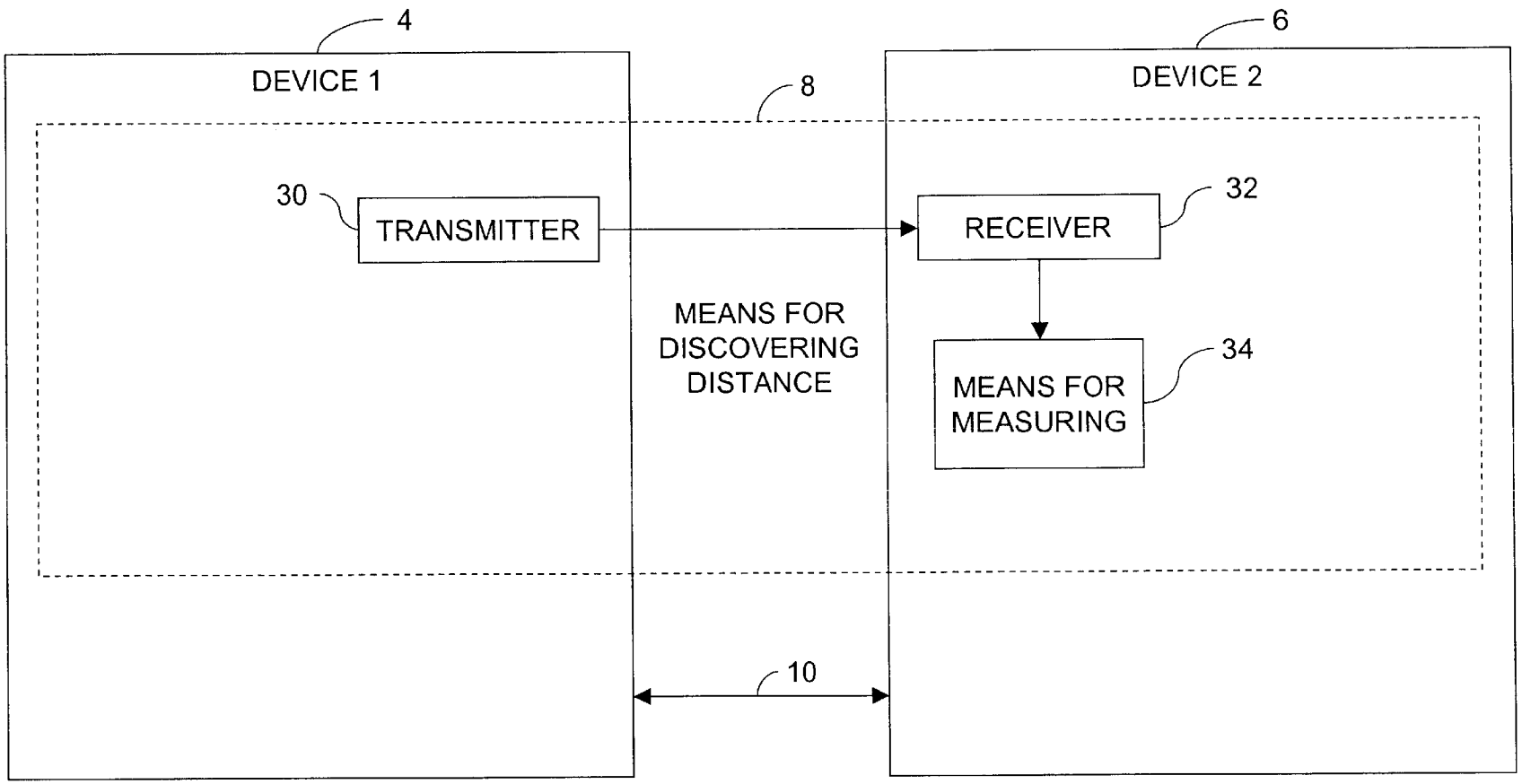
FIG. 3 is a block diagram illustrating in more detail one embodiment of the means for discovering distance in FIG. 1.
Figure 5:
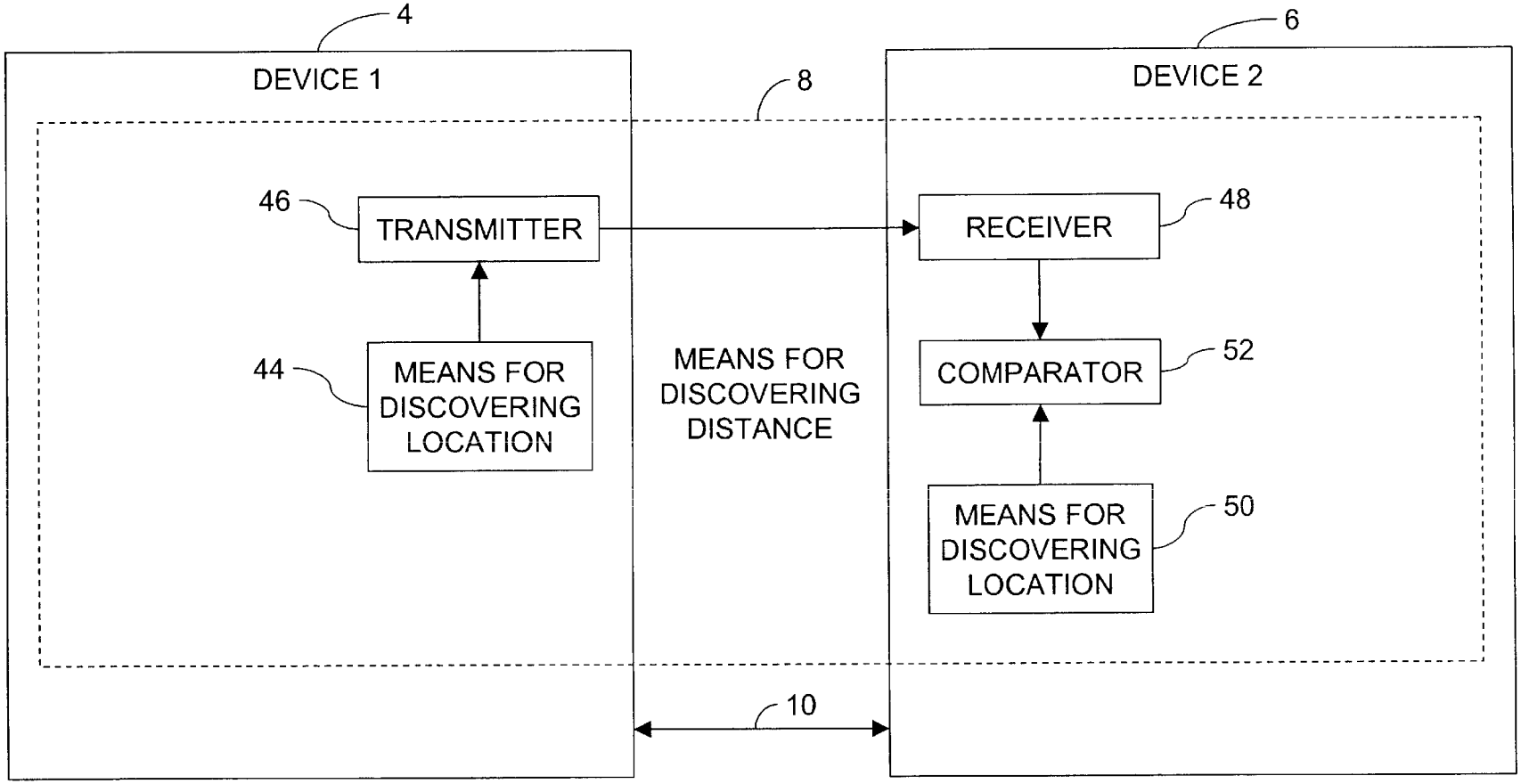
FIG. 5 is a block diagram illustrating in more detail one embodiment of the means for discovering distance in FIG. 1.
Figure 7:
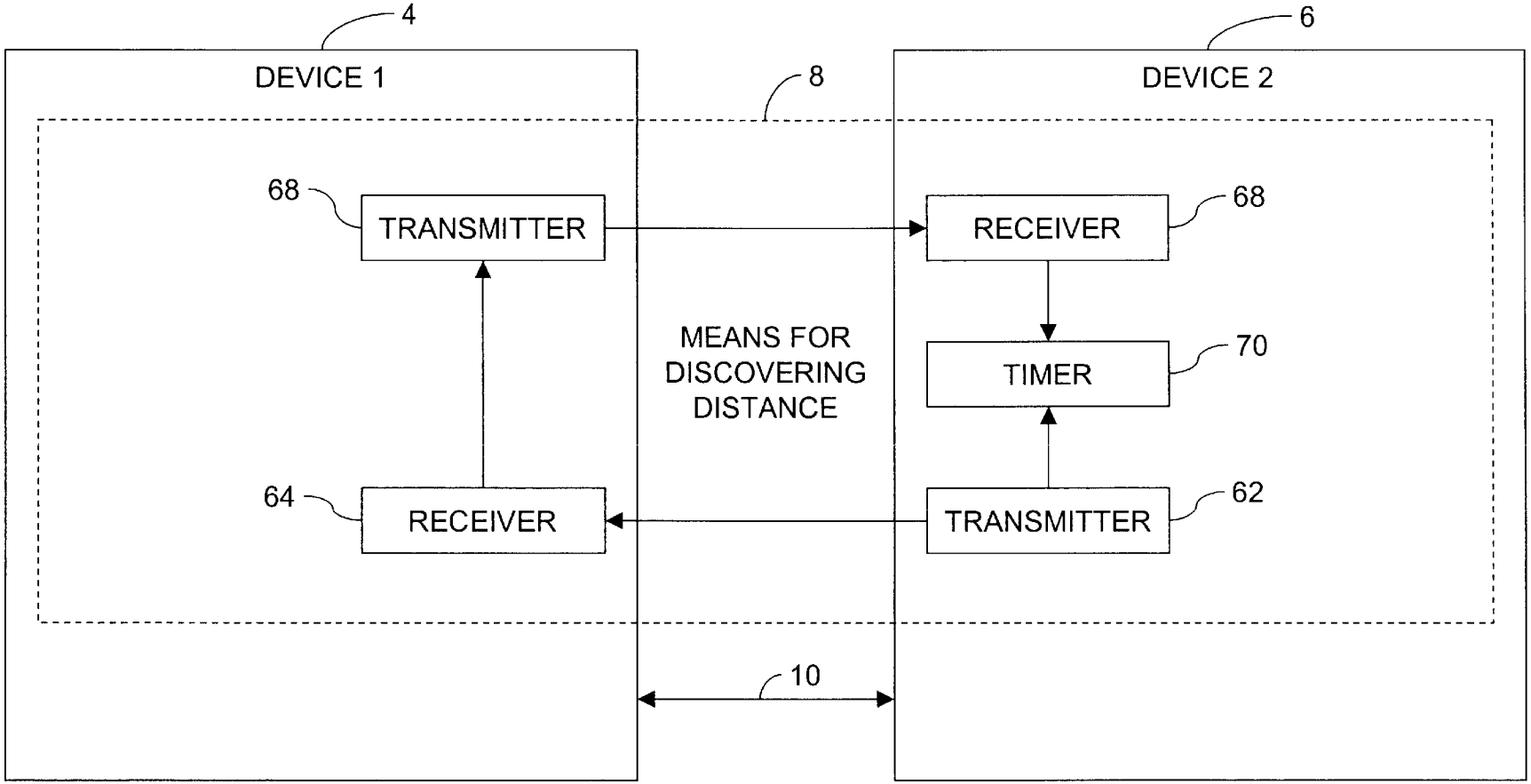
FIG. 7 is a block diagram illustrating in more detail one embodiment of the means for discovering distance in FIG. 1.

Means 8 for discovering distance 10 is any device or combination of devices for discovering the distance between first device 4 and second device 6. FIGS. 3, 5, and 7 illustrate various examples of devices for discovering distance 10.

Figure 2:
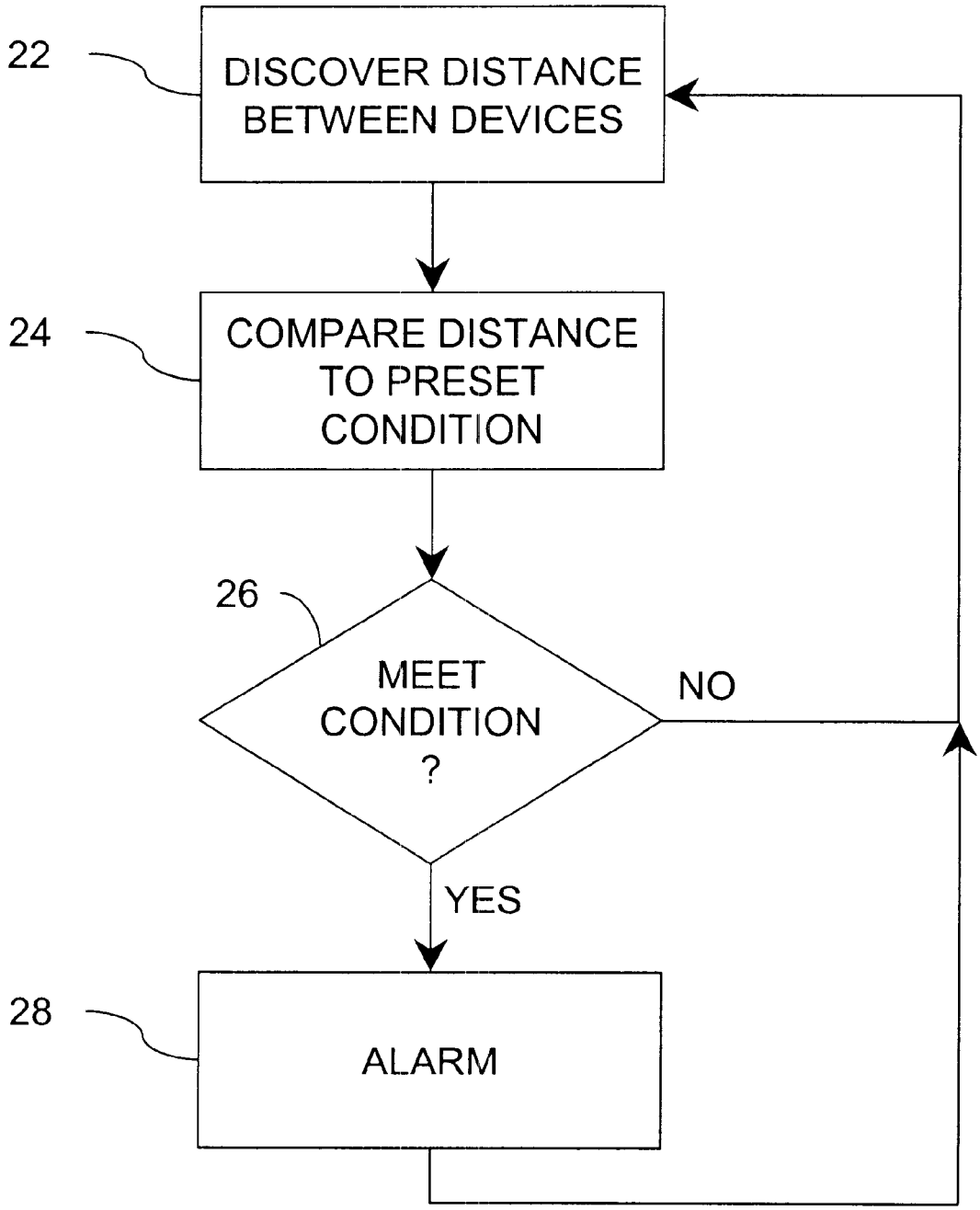
FIG. 2 is a flow chart generally illustrating the method of the present invention.
Figure 4:
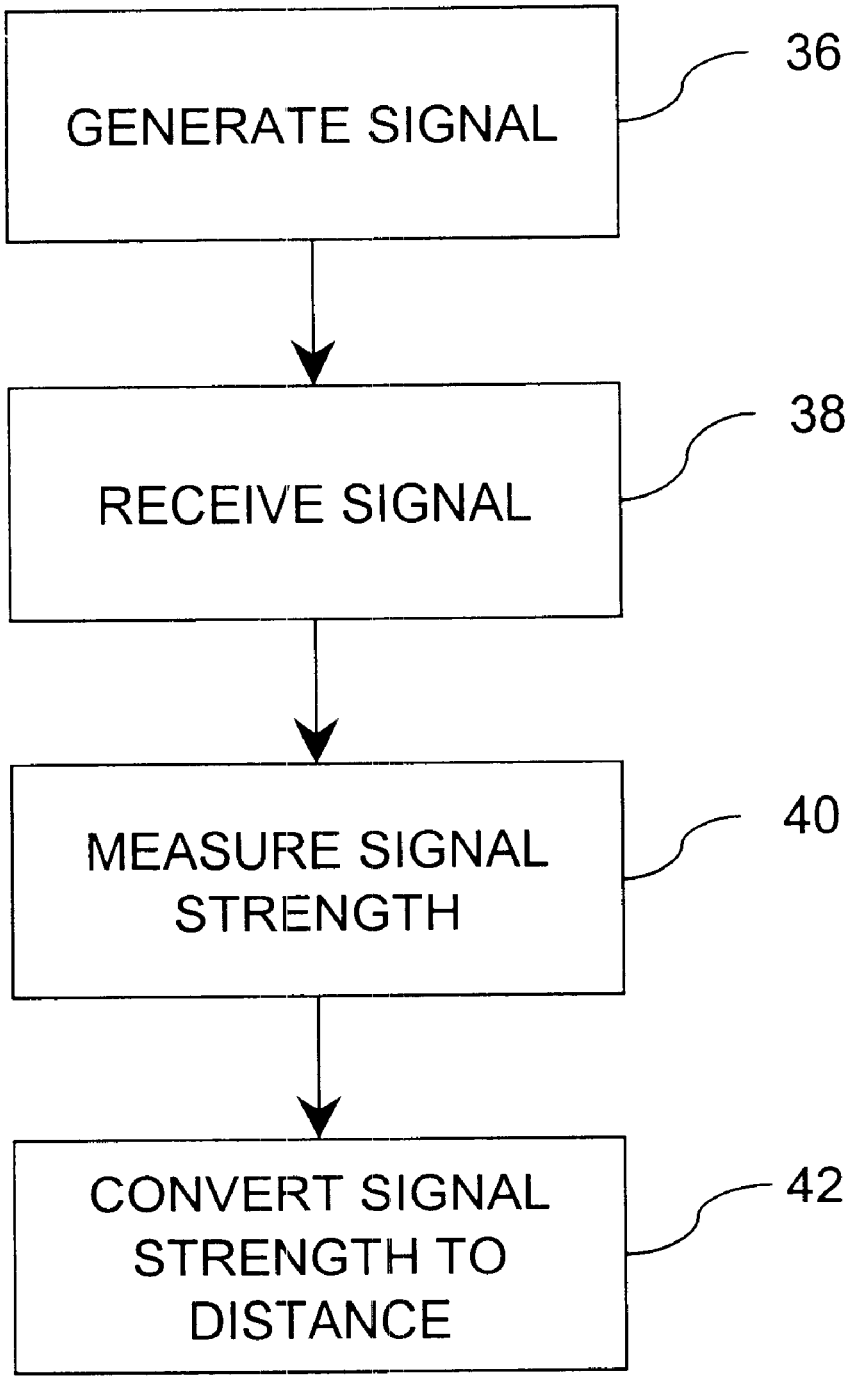
FIG. 4 is a flow chart illustrating in more detail the step of discovering distance in FIG. 2.
Figure 6:
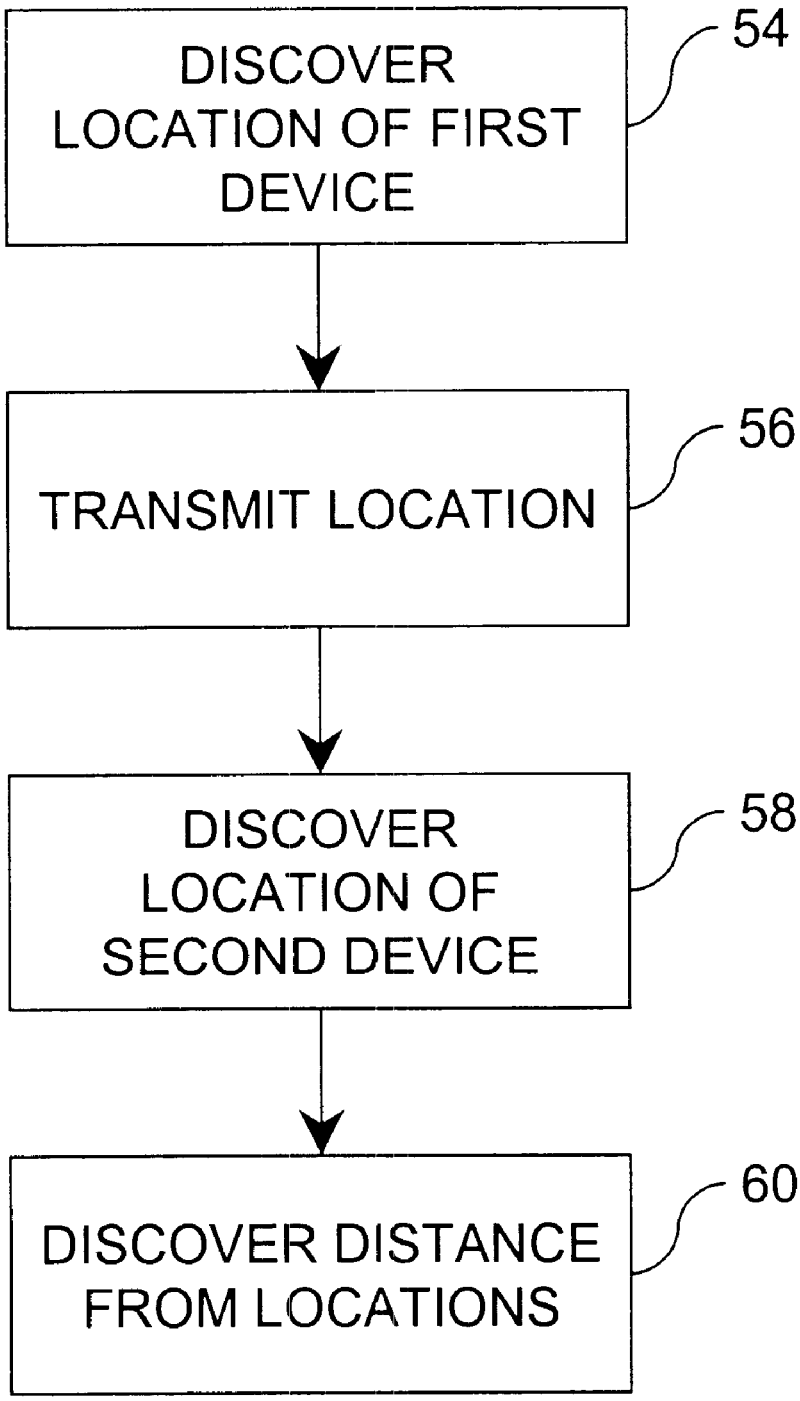
FIG. 6 is a flow chart illustrating in more detail the step of discovering distance in FIG. 2.
Figure 8:
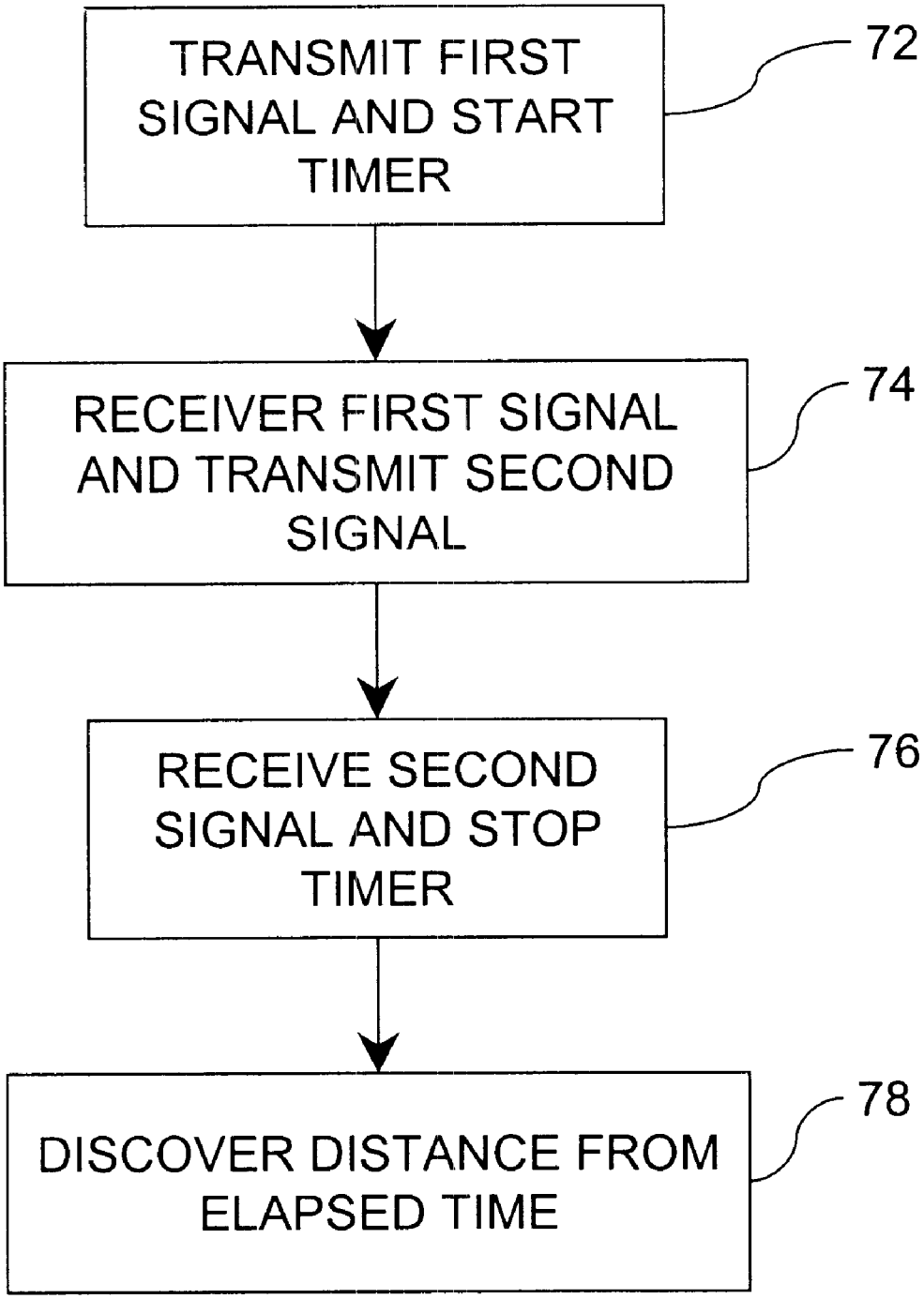
FIG. 8 is a flow chart illustrating in more detail the step of discovering distance in FIG. 2.

FIG. 2 illustrates one embodiment of a method of the present invention for alerting when first device 4 and second device 6 are separated by a distance 10 that meets preset condition 20. Distance 10 is discovered 22 between first device 4 and second device 6. Distance 10 may be discovered through any means. FIGS. 4, 6, and 8 illustrate various examples of means for discovering distance 10.

Once distance 10 is discovered, it is then compared 24 to preset condition 20. If distance 10 does not meet 26 preset condition 20, in one embodiment, the process stops. In an alternate embodiment, the process loops and distance 10 between first device 4 and second device 6 is again discovered 22.

If distance 10 meets 26 preset condition 20, alarm 14 is activated 28. In one embodiment, alarm 14 remains active until manually reset. In an alternate embodiment, the method continues to loop and again discovers 22 distance 10 between first device 4 and second device 6. If the distance 10 no longer meets 26 preset condition 20, alarm 14 is deactivated.

FIG. 3 is a block diagram illustrating one embodiment of means 8 for discovering distance. Means 8 for discovering distance 10 includes a transmitter 30, a receiver 32, and a means 34 for measuring. Transmitter 30 is any transmitter for generating a signal. In one embodiment, transmitter 30 is a transmitter for generating a radio frequency signal. Alternatively, transmitter 30 is a transmitter for generating a signal at any frequency. Receiver 32 is a receiver for receiving the signal generated by transmitter 30.

Means 34 for measuring is any combination of circuitry and executable instructions for measuring the signal strength of the signal received by receiver 32. Signal strength is any factor conveying a strength of a signal. For example, signal strength may include an amplitude of the signal or clarity of the signal.

FIG. 4 illustrates a method for discovering distance 10 corresponding to the means 8 for discovering distance 10 illustrated in FIG. 3. Transmitter 30 generates 36 a signal that is received 38 by receiver 32. The signal has an initial signal strength at first device 4. As the signal travels across distance 10 to second device 6, the signal strength of the signal is attenuated.

The signal strength is measured 40 at second device 6. The measured signal strength may be used as an indication of distance 10 or it may be converted 42 into another form of information indicative of distance 10. Converting 42 the measured signal strength into another form of information indicative of distance may be accomplished by any method. For example, it may be accomplished using a lookup table or by calculating distance 10 from a value indicating the measured signal strength.

FIG. 5 illustrates another embodiment of means 8 for discovering distance 10. Means 8 for discovering distance 10 includes a means 44 for discovering a location of first device 4, a transmitter 46, a receiver 48, a means 50 for discovering a location of second device 6, and a comparator 52.

Means 44, 50 for discovering the locations of first device 4 and second device 6 are any combination of circuitry and executable instructions for discovering the respective locations. For example, means 44, 50 for discovering the locations of first device 4 and second device 6 may be devices for discovering locations using triangulation.

Transmitter 46 is any transmitter for transmitting the location discovered by means 44 to receiver 48. Similarly, receiver is any receiver for receiving the location discovered by means 44 from transmitter 46.

Comparator 52 is any combination of circuitry and executable instructions for discovering distance 10 given the locations of first device 4 and second device 6.

FIG. 6 illustrates a method for discovering distance 10 corresponding to the means 8 for discovering distance 10 illustrated in FIG. 5. Although the steps are presented in a specific order, the scope of the invention is not limited to the order in which the steps are performed, but rather which steps are performed.

Means 44 discovers 54 the location of first device 4. Transmitter 46 transmits 56 the location of first device 4 to receiver 48. Means 50 discovers the location for second device 6. Comparator 52 receives the locations of first device 4 and second device 6 and computes distance 10 between first device 4 and second device 6.

FIG. 7 illustrates a third embodiment of means 8 for discovering distance 10. Means 8 for discovering distance 10 includes a first transmitter 62, a first receiver 64, a second transmitter 66, a second receiver 68, and a timer 70. First 62 and second 66 transmitters are any transmitters for transmitting a signal to first 64 and second 68 receivers, respectively. Likewise, First 64 and second 68 receivers are any receivers for receiving a signal from first 62 and second 66 transmitters, respectively.

Timer 70 is any timing device that may be started when transmitter 62 is activated to send a signal to receiver 64 and stopped when receiver 68 receives a signal from transmitter 66.

FIG. 8 illustrates a method for discovering distance 10 corresponding to the means 8 for discovering distance 10 illustrated in FIG. 5. First transmitter 62 transmits 72 a first signal that is received by receiver 64. Timer 70 is started at the time the first signal is transmitted. Upon receipt of the first signal, by first receiver 64, second transmitter 66 transmits 74 a second signal that is received 76 by second receiver 68. Upon receipt 76 of the second signal by second receiver 68, timer 70 stops. Distance 10 between first device 4 and second device 6 is discovered 78 from the time recorded by timer 70.

Figure 10:
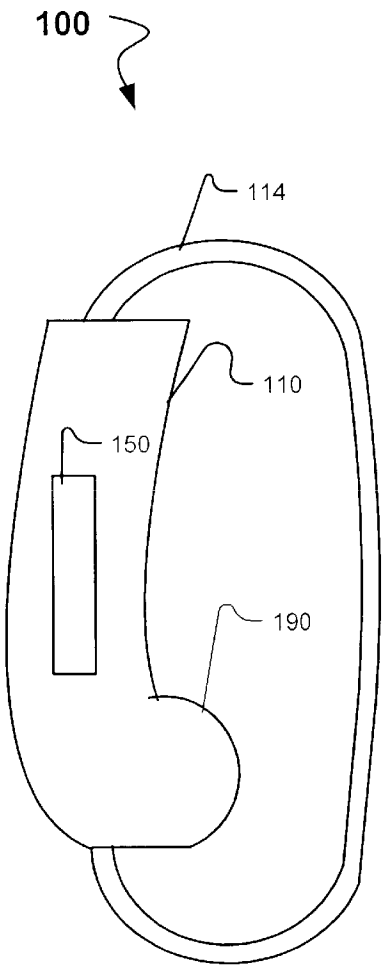
FIG. 10 is a side view of the exterior of the diver communication device of FIG. 9 illustrating the battery compartment.
Figure 9:
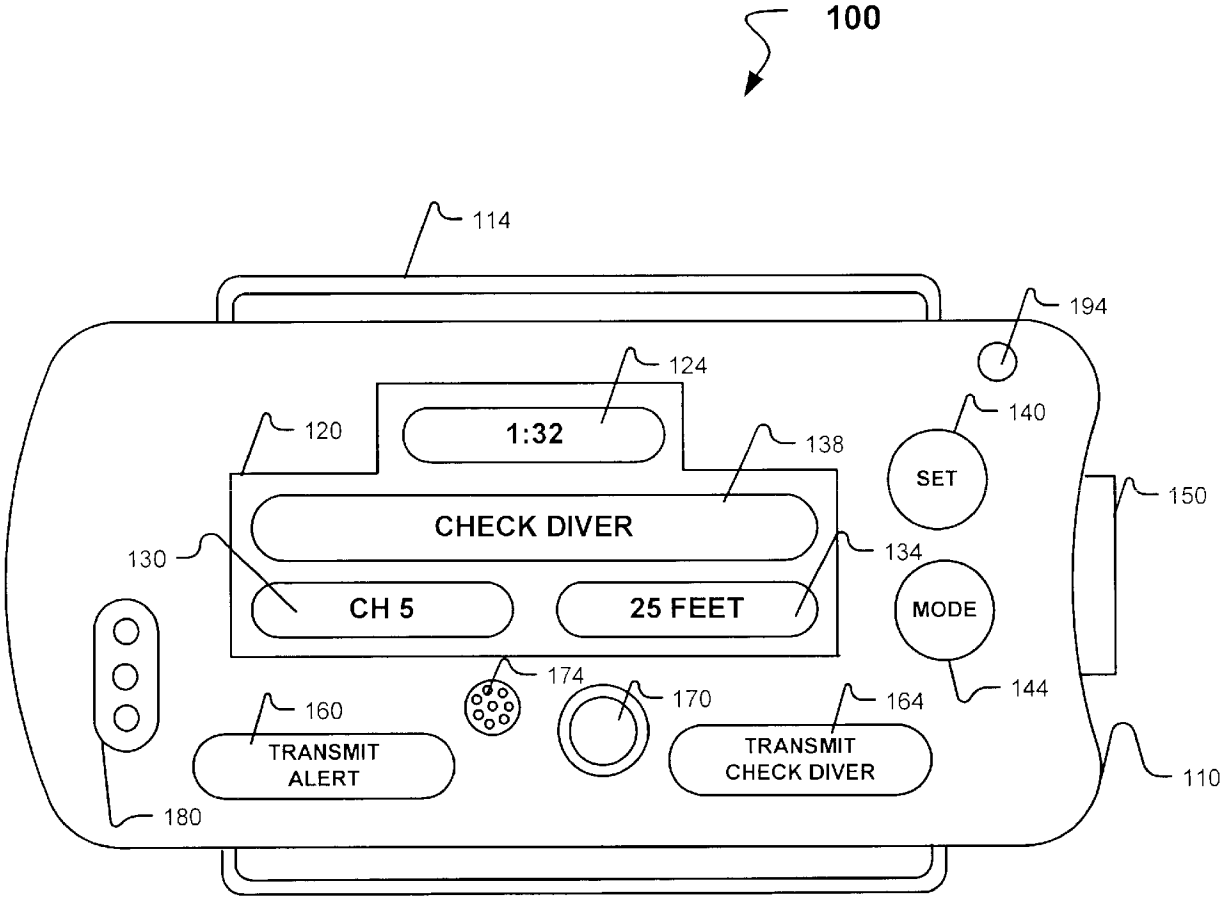
FIG. 9 is a front view of a diver communication device of the present invention illustrating a display surface showing dive time, current separation distance settings, current message from dive partner or dive master, and communication frequency along with other features of the diver communication device.

With an understanding of the various ways that the separation or safety distance can be determined and a corresponding alert signal initiated and issued, a more thorough description of communication features and other features (such as diver location) of a diver communication device are provided with reference to FIGS. 9–12. Referring first to FIGS. 9 and 10, a diver communication device 100 is shown that has multiple functions that enable the device 100 to be used by divers to provide ongoing location monitoring and two-way communication underwater. Significantly, the device 100 is adapted to distinguish between location signals that are transmitted between two or more of the devices 100 and other communication signals, such as automatic alerts, manual panic signals, manually-transmitted check diver signals, and directional indication signals.

To this end, the device 100 includes a waterproof, pressure resistant housing 110 that is used to house the electronic and computer components which facilitate the separation distance monitoring, communication functions (such as transmitting and receiving signals on one or more frequencies or channels), and diver locator or tracking functions as discussed in this detailed description. These components are described in more detail with reference to FIGS. 1–8 and as these are generally known by those skilled in the communications and computer arts, the specific components used to implement the communication and other features of the invention are not limiting or as important as the functions and combinations of functions provided. As shown, the diver communication device 100 includes a retaining strap 114 for attaching the device 100 to a diver's wrist or BCD. A battery that is stored in battery compartment 190 powers the device. In a preferred embodiment, the device 100 includes a battery status indicator 194 (such as a green light when power is above a certain power level or a red or yellow light to indicate a low power level) and the device 100 includes a battery status indicator circuit (not shown) to monitor the power level of the battery in compartment 190 and to operate the battery status indicator 194 as appropriate.

The device 100 includes a display (such as a liquid crystal display) 120 for displaying in textual form information and existing operating parameters and settings. For example, but not as a limitation, the device 100 includes a dive time clock and the display 120 includes a dive time display 124 for indicating the amount of time the diver (i.e., the device 100) has been under the surface or in the water on a particular dive. The device 100 is further configured to allow the device 100 to monitor another device or devices for a separation distance (as explained with reference to FIGS. 11A, 11B, and 12) and for setting or selecting such a distance to be monitored. For example, the device 100 may be configured to determine distances between two or more devices 100 and to compare the determined distance to a predefined safety distance. The display 120 includes a current safety distance setting 134. As shown, the safety distance is set at 25 feet for the device 100. In one embodiment, the device 100 is adapted for supporting 8 safety distances, such as 10, 20, 30, 50, 100, 150, 200, and 250 feet (of course, the device 100 can readily be configured for other useful sets of distance setting and for a wide variety of numbers of safety distance settings). However, an important aspect of the device 100 is that it is configured to be set to monitor and alarm at one or more preferably 2 or more safety distances which can be set for each dive group (i.e., for each device 100 used by divers within a dive group) and whichever the current setting is for the device 100 is displayed at 134. In some embodiments, the determined distance calculated by the data processor as explained in detail with reference to FIGS. 1–8 is displayed on the display 120 (such as at 134). The display of the determined distance may be initiated manually by an operator of the device 100 such as in combination with the direction indicator 180 by pressing a switch (not shown) and/or automatically with the receipt of a message with the distance displayed being associated with the separation distance between the device transmitting the message displayed at 138 and the receiving device 100.

Another important feature of the device 100 is that it is operable to communicate with other devices 100 set at a particular communication channel or setting. Typically, the device 100 is set at a particular channel and this channel is shown at 130 on the display 120. The device 100 is preferably configured to be set at a plurality of communication channels to allow the use of the device 100 for differing dive groups concurrently without resulting communication interference. For example, when two dive groups are diving in proximity at a particular time one group may set their devices 100 at a first channel and the second group may set their devices at a second channel. Each of the channels may correspond to a single or set of transmission frequencies (e.g., for sound waves or transmission signals at frequencies up to 20 kHz to 600 kHz or higher and selected to suit the particular transmitter and receiver pairs utilized) used by the device 100 for transmitting location signals, alert signals, and check diver signals (as discussed with reference to FIGS. 11A, 11B, and 12). The device 100 may utilize sonar transducer assemblies (and software run by a data processor for determining distances and diver directions and other functions described herein) with acoustic capabilities useful for transmitting and receiving the distance determination signals, location beacon signals, and communication signals, such as a 70 kHz sonar transducer or other devices known to those skilled in the art with the specific implementation not being limiting of the device 100.

When the device 100 receives a communication signal, the display 120 is operated to display the type of signal being received from another device 100. As shown, a signal type display area 138 is provided in display 120 for showing in text the type of signal being received, e.g., "CHECK DIVER" which is used by one diver to obtain the attention of the receiving diver or "EMERGENCY" which is used by a diver to indicate a dangerous situation. The device 100 supports communication between 2 or more users of the devices 100 (or between a diver device 100 and a dive master communication device or master controller that is configured for operating concurrently on a number of communication channels corresponding to the number of dive groups being led by the dive master or operator). As shown, the device 100 includes a transmit alert button 160 for initiating or transmitting an alert signal to the other devices 100 operating on the same communication channel (i.e., the channel shown or indicated at 130). This feature allows a diver to manually activate the alert transmission system or components of the device 100. When the device 100 receives such an alert signal, an alert or emergency message is displayed in text message area 138 (such as a text message including "EMERGENCY"). This feature is useful for a diver using the device 100 to quickly inform other divers using devices 100 that there is a dangerous emergency situation (such as the presence of a dangerous shark, a diver becoming trapped or hurt, and the like). Additionally, a message receipt indicator light 170 may be lit (such as a pulsing or steady light). Optionally, the device 100 may include a component for causing the housing 110 or a portion of the housing 110 to vibrate. Further, a speaker 174 may be provided to acoustically or audibly notify the operator of the device 100 that a message has been received, such as with "pinging" or other sounds. The device 100 will activate these same indicators when an automatic transmission of an alert signal is initiated by a device 100 upon a determination that the safety distance (as set and shown at 134) has been exceeded.

The device 100 further includes a transmit check diver button 164 to allow an operator of the device 100 to transmit a signal or message informing a receiving one of the devices 100 that they should get a visual of the sending diver. The "CHECK DIVER" message (or another alert message) may be displayed at 138 and otherwise indicated by 170, 174 upon the receipt of the check diver or obtain-visual signal. The alert and check diver signal receipts at 138, 170, 174 may be manually turned off or suppressed by pushing button or switch 150. This is a useful feature for clearing the device to allow the receipt and display of additional messages that may be received from another device 100 (i.e., other than the one that sent the presently displayed message in 138) which is important in multi-diver groups or the same device.

In one embodiment, the device 100 includes memory (not shown in FIG. 9) for storing the receipt of a message or messages in a queue and displaying (at 138 and with message indicators 170, 174) the stored messages upon the clearing of a previously received message. Further, in one embodiment, the device 100 is adapted for prioritizing received messages to display the highest priority message. For example, if a check diver signal is received from a first diver communication device when an alert or panic signal is received from a second diver communication device, the device 100 is adapted to receive the panic signal and to override display of the check diver message and display the panic message at 138 and at 170, 174 (such as with a flashing light and a differing sound). As will be appreciated, the message queuing and message prioritizing features of the device 100 are particularly useful when the diver communication device 100 is used in dive groups with more than two divers and/or on dives involving a dive master with a communication device (similar to device 100). In these environments, it is important that panic messages and automatic alerts based on separation distances being exceeded are received and displayed. In typical embodiments, manual alerts are given highest priority, automatic alerts are given intermediate priority, and check diver messages are given lowest priority.

The device 100 also includes a set button 140 and a mode button 144 to allow a user or diver of the device 100 to check current device 100 setting and, at least in some embodiments, to change these settings or parameters. The device 100 may be configured in numerous fashions for selecting particular parameters for viewing, for indicating which parameters are to be changed, for displaying alternative settings, and then selecting a new setting. For example, in one embodiment, the mode button 144 is depressed to display current settings of the parameters of the device that can be reset or changed, such as dive time 124, communication frequency 130, and safety distance 134. The mode button 144 is depressed again to begin the setting process for each parameter and then pressed again to see options and the set button 140 depressed when a desired parameter is displayed at 124, 130, or 134. For example, the mode button 144 may be depressed twice to begin setting dive time 124 and a third time to reset the time followed by depressing the set button 140. The mode button 144 is depressed again to begin setting the communication channel 130 with the mode button 144 depressed sequentially to reach a desired communication channel and then the set button 140 is depressed to choose and set that communication channel 130. Similarly, the mode button 144 is again depressed to begin setting the safety distance 134 and when a desired safety distance is shown at 134 the set button 140 is selected. Only selectable communication channels and selectable safety distances (as defined by a predefined set stored in memory of device 100) are displayed during the setting process.

In the illustrated embodiment, the diver communication device 100 further includes a dive partner direction indicator 180. As illustrated, the direction indicator 180 includes a series of lights that indicate a direction of another diver communication device 100. For example, the indicator 180 may include a green, a yellow, and a red indicator light. The direction of the other diver communication device 100 is indicated by lighting the green light when the device 100 is pointed in a substantially correct direction, by lighting the yellow light in the indicator 180 when the device is pointed in a relatively correct direction, and by activating the red light in the indicator 180 when the device 100 is pointed in an incorrect or opposite direction from the other, transmitting device 100. Alternatively, directional arrows may be provided in the indicator 180 to provide directional information for a transmitting device 100. In preferred embodiments, the device 100 includes a location beacon activation switch (not shown) which can be manually activated by a user of the device 100 to begin transmitting a location beacon or signal (e.g., a signal on a different frequency than other communication signals transmitted by the device 100). This manual feature is useful when a diver becomes entangled or hurt but can still operate the device 100 and in multi-diver groups in which it may be difficult to differentiate location signals from multiple devices 100. Each device 100 then includes a location beacon receiver and a device for processing the location beacon signal to determine the location of the transmitting device 100 and to indicate this location with the indicator 180. Alternatively, the location beacon signal may be transmitted by the device 100 automatically whenever the safety distance is exceeded or whenever the transmit alert button 160 is depressed. In yet other embodiments, the location signals transmitted on an ongoing basis for separation distance determination are utilized by the device 100 to determine the direction one device 100 is from another transmitting device 100. In these embodiments, the device 100 may include a switch (not shown) for activating this diver tracking function and to activate operation of the indicator 180.

According to another aspect of operating the device 100, each device is preferably calibrated for use in specific dive locations. As discussed earlier, water does not provide a consistent communication medium and the use of signal strengths and travel times to determine location and/or separation distance by the devices 100 may vary in accuracy if only one operating setting were used, i.e., no calibration. Instead, the device 100 can be calibrated for the chemical makeup of each dive location, such as for salinity. In this manner, the accuracy of the device 100 can be improved and the need for safety distances with tolerances is not as necessary. In some cases, calibration is provided to account for anticipated dive depths. For example, the water makeup and other communication factors such as water pressures may vary with dive depth. The water content and operating conditions are determined for the dive location and the device 100 is calibrated for that depth at that dive location. This is particularly useful for deeper dives, such as for recovery efforts. When dives will cover a wider range of depths, an average salinity and other operating characteristics may be used to perform calibration with acceptable results. For example, the device 100 may be calibrated for an average salinity and average dive conditions. The device 100 then may be tested to determine variances in different salinities and these variances provided to users (e.g., by indicating that determined safety distances may vary by a certain distance if the salinity is within a certain range, with the salinity being determined at the dive location with a salinity kit or otherwise).

Figure 11A:
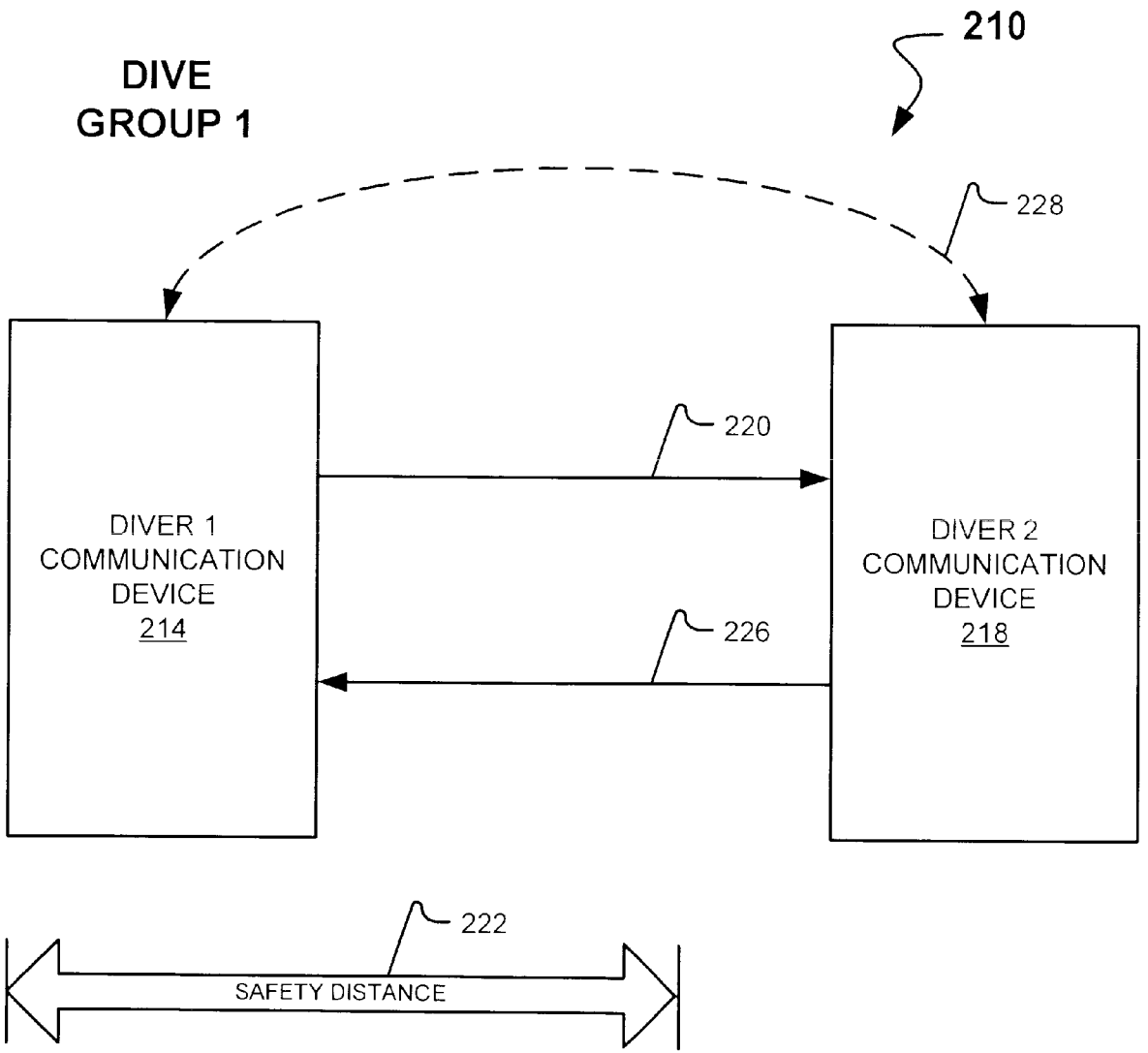
FIGS. 11A and 11B are functional block drawings of communication between two divers in a dive group and between three divers in another dive group illustrating the use of safety distance settings and alert signals and the use of check diver signals.
Figure 11B:
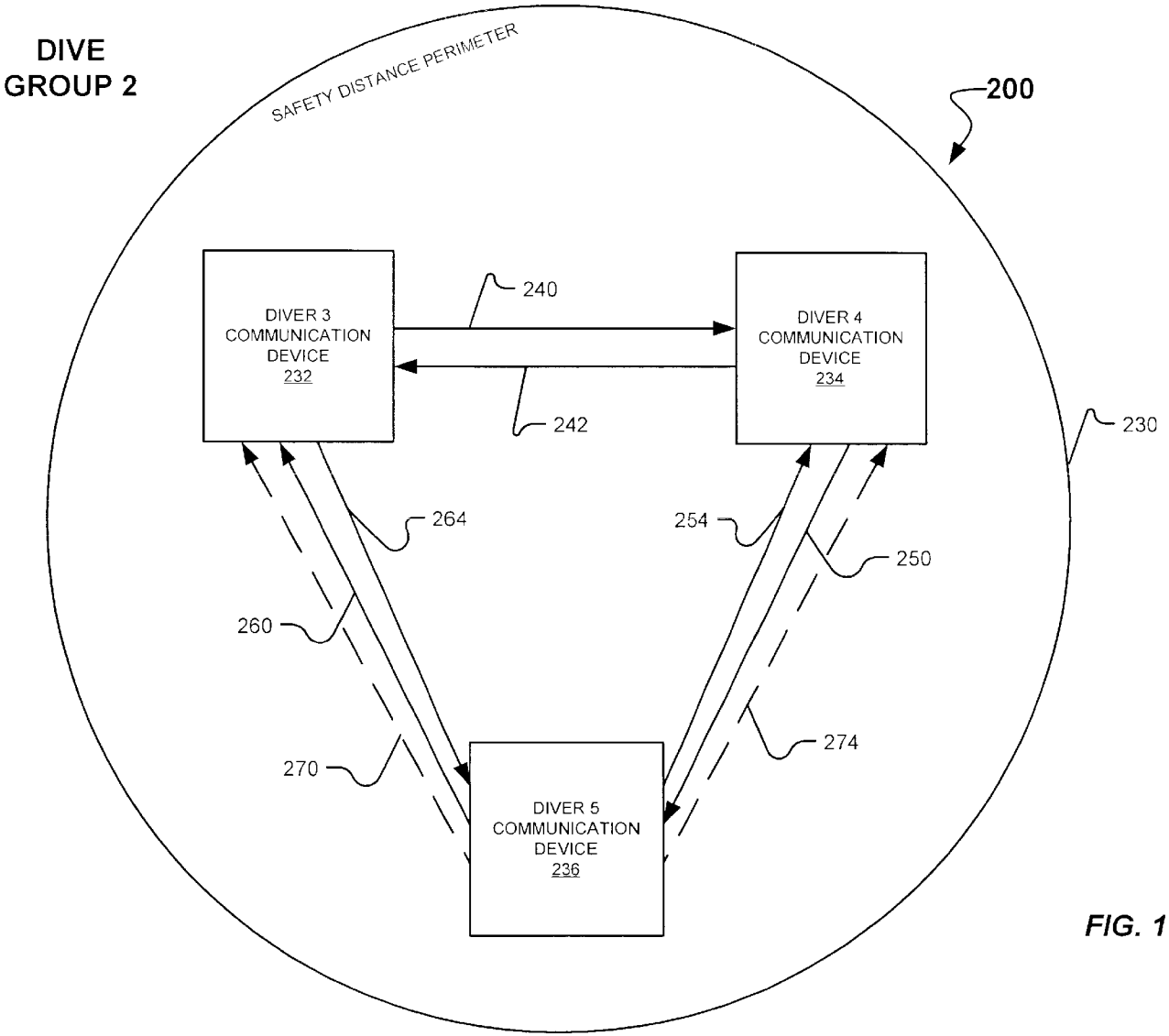

Referring now to FIGS. 11A and 11B, operation of the diver communication device 100 will be described first in the context of one-to-one communications between two dive partners (see FIG. 11A) and in the more complicated case of multiple dive partners within a single dive group (see FIG. 11B). FIG. 11A illustrates a diver communication system 210 being used by a Dive Group 1 including two divers operating a Diver 1 communication device 214 and a Diver 2 communication device 218. Location signals 220 and 226 are transmitted on an ongoing or at least periodic basis for use by the communication devices 214 and 218 in determining the distance between the two devices 214, 218. As illustrated, a safety distance 222 has been set in both devices 214, 218 (e.g., using the mode and set buttons 140, 144 of FIG. 9). Based on the location signals 220, 226, the devices 214, 218 determine that the separation distance now exceeds the safety distance 222. At this point in operation, the devices 214, 218 may alarm by displaying a check diver or alert message on the display 138 (or some other message indicating the safety distance 222 has been exceeded) and optionally, by automatically transmitting an alert signal 228 to the other one of the devices 214, 218. The alarm and/or receipt of the alert message 228 are preferably indicated by a vibrator within the devices 214, 218, by steady or pulsing lights (such as light 170 in FIG. 9), and/or an audible alarm (such as with speaker device 174 shown in FIG. 9). In a preferred embodiment, each of the devices 214, 218 in system 210 are set to communicate at a communication channel (such as a numbered channel as shown at 130 of FIG. 9). This communication channel setting defines the frequencies of the signals 220, 226 and 228 such that these can be transmitted and received successfully by the devices 214, 218. Although not shown, the diver communication devices 214, 218 can also be operated to transmit communication messages manually (such as a panic message or a check diver message) as explained in detail with reference to FIGS. 9 and 10.

Referring now to FIG. 11B, a communication system 200 is being used by three divers operating a Diver 3 communication device 232, a Diver 4 communication device 234, and a Diver 5 communication device 236. Significantly, the communication system 200 can be operated concurrently with the communication system 210 and in proximity (even within the safety distances 222 and safety distance perimeters 230). Communication interferences or other problems are avoided by having the devices of Dive Group 2 setting their devices 232, 234, 236 at a different communication channel that is defined to utilize one or more transmission frequencies that are not utilized by the devices 214, 218 of Diver Group 1 or system 210. In other words, each communication channel defines a range of signal frequencies that can be used by the devices 214, 218, 232, 234, 236 without concern of interference or receipt of signals transmitted by devices outside a particular dive group. In this manner, each dive group system 200, 210 is adapted for to allow divers using the devices 214, 218, 232, 234, and 236 to communicate with divers within their group only.

The system 200 illustrates that Dive Group 2 includes three devices 232, 234, 236 (and in some groups numerous other devices may be used) and stresses the idea that the functions of the invention are useful for facilitating concurrent multi-diver communications. As shown, each of the devices 232, 234, 236 have a safety distance set and, as shown, the separation distance of each of the devices 232, 234, 236 does not exceed this preset distance as shown by the safety distance perimeter 230. During operation, device 232 transmits location signals 240 and 264 to devices 234, 236, respectfully, while receiving location signals 242, 260 from these same devices 234, 236. The device 232 then uses these signals to determine the present separation distances between devices 232 and 234 and between devices 232 and 236. Likewise, the other two devices 234, 236 transmit and receive location signals 240, 242, 250, 254, 260, and 264 to allow them to determine the separation distances between the devices, i.e., each of the devices 232, 234, 236 operates to determine the safety distance with each of the other devices 232, 234, 236 and compares this to a preset safety distance to insure that the entire group is presently within the safety distance perimeter 230. As shown, the devices 232, 234, 236 are within the perimeter 230 so no alarming or alert messages transmitting is being performed by the devices 232, 234, 236. If one of the devices 232, 234, 236 does go outside the perimeter 230 (which, of course, moves with the diver devices 232, 234, 236 and is actually spherical in shape or three dimensional), each of the devices 232, 234, 236 will alarm and/or transmit alert (or safety distance exceeded signals) to the other devices 232, 234, 236.

As illustrated, however, the device 236 is transmitting messages 270 and 274 to the devices 232, 234. The message 270 is sent on a frequency dictated by the communication channel setting for the system 200, such as the same as the location signals or at a different frequency within the range of frequencies reserved for the communication channel of Dive Group 2 (in this case, the devices 232, 234, 236 may be equipped with additional receivers to allow the devices 232, 234, 236 to receive 2 or more messages at different frequencies concurrently and without changing receiving frequencies by an operator). The messages 270, 274 are typically transmitted concurrently for concurrent receipt by devices 232, 234. As discusses with reference to FIGS. 9 and 10, the messages 270, 274 may be panic signals or check diver signals. The devices 232, 234 process the received messages 270, 274 and indicate the receipt of the messages 270, 274 (such as by lighting a steady or pulsing light 170, operating an audible signal receipt indicator 174, and displaying a text message 138 as shown in FIG. 9).

In some embodiments, the diver devices 232, 234, 236 cannot determine which of the other diver devices 232, 234, 236 transmitted the messages 270, 274 but the location indicator 180 can be used in some embodiments to determine the direction of the transmitted devices 232, 234, 236 to allow the operators or divers to visually locate the other divers and identify the transmitting diver. In other embodiments, the messages 270, 274 include data that identifies the transmitting device 236 and the devices 232, 234 operate to process the signals 270, 274 to identify the sending device 236 using an include data processing device and in some cases, information in memory useful for identifying a transmitting device by the data added to the messages 270, 274. The transmitting device 236 can then be displayed in a text message on the display 120 (such as in field 138). In this manner, multiple divers can communicate within a dive group rather than only two dive partners.

Figure 12:
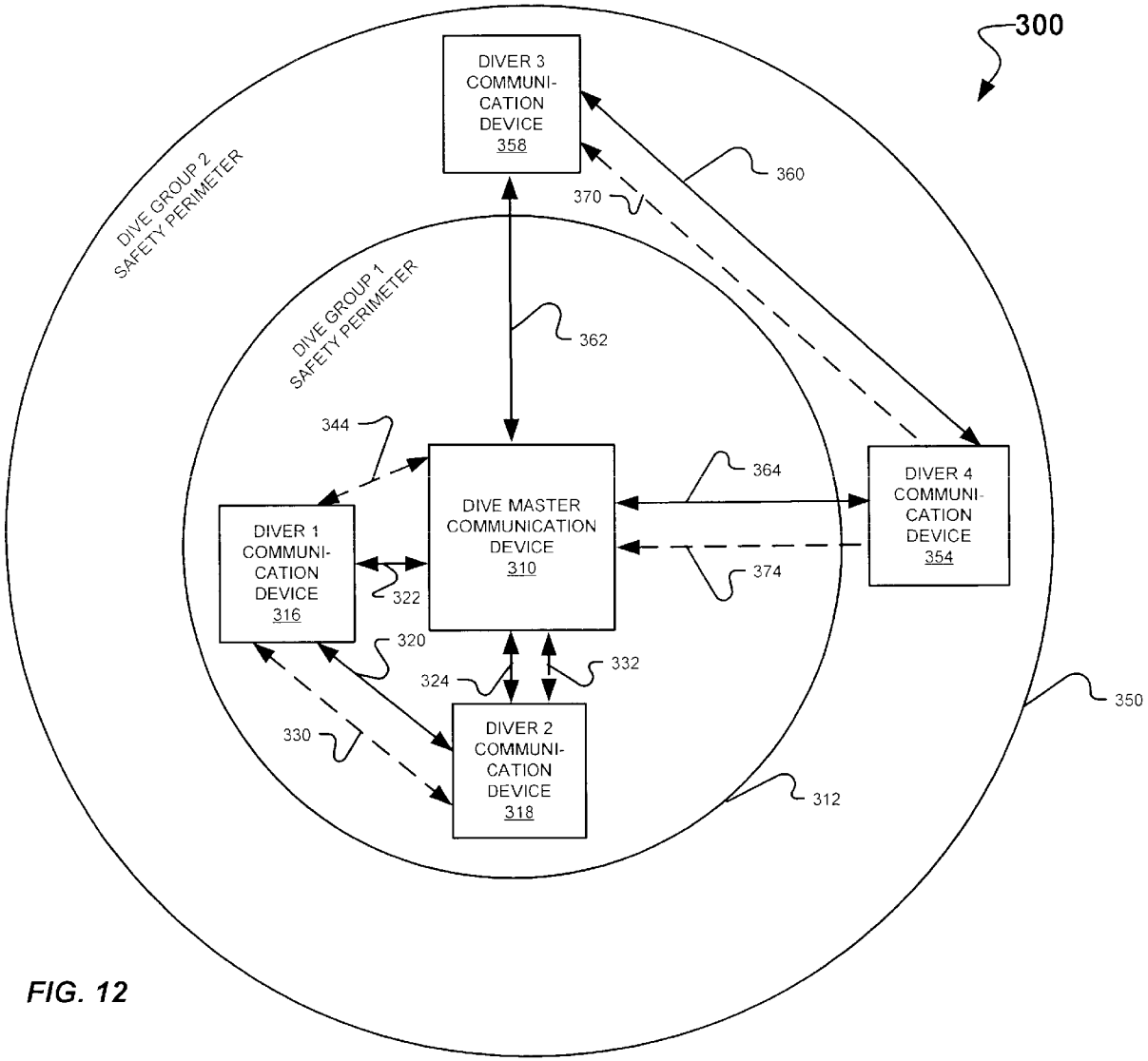
FIG. 12 is another functional block drawing similar to FIGS. 11A and 11B illustrating the use of a dive master communication device for concurrently monitoring divers in two separately communicating dive groups that are diving using different safety distances.
Figure 13:
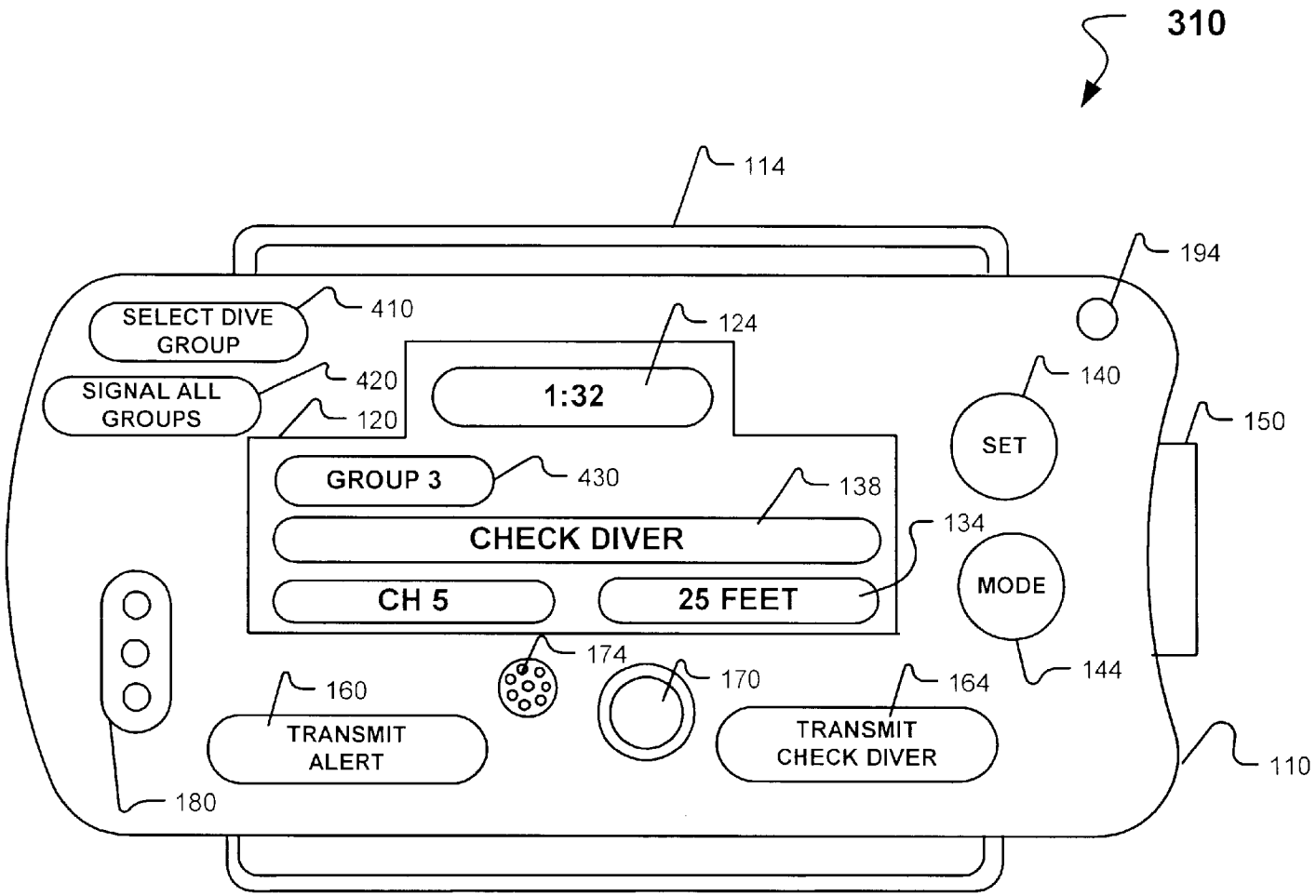
FIG. 13 is a front view of a dive master communication device or master controller illustrating features similar to the diver communication device of FIG. 9 and also illustrating features facilitating monitoring and communicating with multiple diver and dive groups.

While FIGS. 11A and 11B provide a good illustration of the use of diver communication device of the invention for communications between divers within dive groups, another important embodiment of the invention is a dive master communication device to communicate with and monitor the location of 2 or more dive groups. As shown in FIGS. 12 and 13, it is often desirable for a dive master or dive leader to bring several dive groups on a dive with each dive group made up of 1, 2, or more divers each potentially using different safety separation distances and communicating among themselves (as described for systems 200, 210 of FIGS. 11A and 11B). According to the invention, a dive master communication device 310 can be provided in a dive communication system 300 to provide these desired functions and be configured as shown in FIG. 13. For example, the master device 310 can monitor communications and locations of a single dive group or of all dive groups being led by the master device 310. The master device 310 in turn can be operated to transmit communications or messages (such as check diver or panic) to one group at a time or to all of the groups concurrently. Each of these features will now be discussed with more detail with reference to FIG. 12 (and with reference to the device 100 of FIG. 9 which can be altered slightly to provide the functions of the dive master communication device 310).

As shown, the system 300 includes a first dive group using one safety distance as shown by safety perimeter 312 and including two diver communication devices 316, 318 (two devices are shown for simplicity but more may be included). A second dive group is diving in the same area and is also being monitored by the dive master communication device 310. The second group is operating with a different, larger safety distance that defines a safety perimeter 350. As shown, the safety distances are being defined relative to the master device 310 (i.e., the safety distance is being measured from the master device 310 as well as the other diver communication devices within each group) but in some embodiments not shown, the safety distance may only be measured among the devices within each group with no location signals being sent to the device 310.

During operation, the devices 316, 318 will be set to use one communication channel (defining the frequencies of group signals) while the devices 354, 358 in the other dive group are set to use a second communication channel (defining this dive group's communication frequencies). The dive master communication device 310 on the other hand is configured with adequate receivers and transmitters to operate within both of these communication channels. In some embodiments, the device 310 is adapted such that a user would manually switch between channels to monitor sequentially each group and the devices 316, 318, 354, 358 messaging and to transmit messages to the devices in that group. As shown in FIG. 13, the device 310 includes a select dive group button 410 to allow the dive master to choose a dive group to monitor or to choose a dive group for communications. The dive group selected is displayed at 430. In this mode, the dive master can then select the transmit alert button 160 or transmit check diver button 164 to cause the device 310 to transmit communication signals to the selected dive group. Alternatively (and optionally), the device 310 may include an all groups button 420 to cause the device 310 to operate to transmit communication signals to all dive groups concurrently (with "ALL" shown at display 430) by operating all transmitter devices (such as sonar transducer assemblies).

In other embodiments, the device 310 is adapted to only display messages from one group at a time (such as on a display 120, 170, 174 as shown in FIG. 13) but is also able to receive messages from each device 316, 318, 354, 358 concurrently. In this embodiment, the device 310 may store messages not being presently displayed in a memory and then display the messages when that group is selected (such as with button 410) by the operator of the device 310. The stored messages may be prioritized, such as panic, safety distance exceeded, and check diver in descending priority. Alternatively, priority messages such as manual panic messages may be given an interrupt priority and the device 310 would operate to automatically switch the display 120 to shown the higher priority message. In yet another alternative embodiment, a message received indicator (such as an additional light on the device 100 and in some cases, a light may be provided for each dive group being monitored by the device 310 with a label indicating which group the message has been received from or by use of display 430) may be used to inform an operator of the device 310 that while the selected message is being viewed another message (such as a panic or a distance exceeded) has been received. The operator would then operate the device 310 to select the communication channel for other dive groups by depressing button 410.

Referring again to FIG. 12, the master controller 310 receives and transmits location signals 322, 324 from and to the devices 316, 318 while these same devices 316, 318 exchange location signals 320. In this fashion, the master controller 310, and diver communication devices 316, 318 are each able to determine separation distances and whether safety distances have been exceeded. The devices 316, 318 are able to communicate with each other with signals 330 (such as with check diver signals). Further, the master controller 310 may monitor these signals 330 and may transmit or receive signals from the devices 316, 318 with messages 332, 344 (such as if one of these devices 316, 318 were to depress a transmit alert button 160). For example, the master controller 310 may concurrently transmit a panic message 332, 344 indicating that the divers operating the devices 316, 318 should surface or take other precautions.

The devices 354, 358 are operating on a different communication channel and are concurrently with the operation of devices 316, 318 transmitting location signals 360 between themselves and location signals 362, 364 with the dive master communication device 310. In this manner, the separation distances between the devices 310, 354, 358 are determined by each of the devices without interfering with similar operations by the devices 316, 318. Again, the devices 354, 358 may communicate with each other by transmitting signals (such as check diver, manual panics, automatic distance exceeded messages, and diver direction or homing beacon signals). These communications may be monitored by the device 310 if it is operated to receive this channel by depressing dive group select button 410 or on an ongoing basis if the device 310 is configured with a plurality of receivers for concurrently monitoring each device 316, 318, 354, 358 in each of the dive groups. The dive master device 310 may transmit messages to the devices 354, 358 by selecting the communication channel of devices 354, 358 by pressing button 410. In one embodiment, the device 310 is adapted to transmit messages to all devices 316, 318, 354, 358 concurrently by first press the signal all groups button 420 and then pressing communication signal initiation button 160 or 164 and includes a transmitter or, more typically, a plurality of transmitters. This is useful for sending a manual emergency or check diver (simply to get the divers attention) message to all dive groups at one time. As illustrated, the device 354 is transmitting manual emergency messages 370, 374 to the device 358, 310. As with the diver communication devices 316, 318, 354, 358, the master device 310 preferably would be equipped with a tracking device and display 180 for finding a device that had activated its homing or direction beacon or signal (e.g., manually in the case of trouble or automatically at the loss of power to transmit location or communication signals (with the beacon having a separate power sources)). The dive master communication device 310 is a useful embodiment of the diver communication device with features that allow a single device 310 to be operated to monitor and communicate with multiple divers communicating within different dive groups using the diver communication devices 316, 318, 354, 358.

It should be understood that the foregoing description is only illustrative of the invention. Various alternatives and modifications may be devised by those skilled in the art without departing from the invention. For example, the present invention may incorporate a manually activated alarm that bypasses the comparison of distance 10 to preset condition 20 and activates alarm 14. Additionally, diver and dive master communication devices may be configured to monitor the receipt of the location signals and to alarm upon the cessation of these signals (which may indicate loss of power in a device or other communication problems that should be investigated by the divers operating the communication device). Accordingly, the present invention is intended to embrace all such alternatives, modifications, and variances that fall within the scope of the appended claims.

What is claimed is:

1. A communication device for use underwater by a scuba diver for communicating with and tracking relative direction of one or more other divers, comprising:

a transmitter and receiver assembly transmitting distance signals to and receiving distance signals from an other one of the communication devices, wherein the distance signals are transmitted and received on a frequency defined by a communication channel;

a data processor processing the received distance signals to determine a separation distance between the communication device and the other device and for comparing the separation distance to a safety distance, wherein the separation distance determination comprises timing the received distance signals; and a display and control assembly including a display for indicating the communication channel and the safety distance of the communication device and for indicating when the data processor determines the separation distance exceeds the safety distance.

2. The communication device of claim 1, wherein the display and control assembly includes a setting input device operable by the diver to set the safety distance or the communication channel.

3. The communication device of claim 1, wherein the transmitter and receiver assembly is further adapted for transmitting to and receiving from the other device communication signals on frequencies defined by the communication channel and wherein the data processor is adapted to process the received communication signals and operate the display and control assembly to indicate receipt of the received communication signals.

4. The communication device of claim 3, wherein display and control assembly includes a light for indicating receipt of the communication signals.

5. The communication device of claim 3, wherein the display and control assembly includes a text message display and wherein the data processor operates the display and control assembly to display a text message based on the received communication signals.

6. The communication device of claim 3, wherein the communication signals include a panic signal and the text message indicates the received message was a panic signal and wherein the display and control assembly includes a transmit panic signal device operable by the diver to cause the transmitter and receiver assembly to generate and transmit one of the panic signals.

7. The communication device of claim 3, wherein the communication signals include a check diver signal and the text message displayed indicates the received message was a check diver signal and wherein the display and control assembly includes a transmit check diver signal device operable by the diver to cause the transmitter and receiver assembly to generate and transmit one of the check diver signals.

8. The communication device of claim 1, wherein the transmitter and receiver assembly are further configured for transmitting a location beacon and for receiving location beacons from the other device and wherein the data processor is adapted for processing received location beacons to determine a direction of the other device relative to a location of the communication device.

9. The communication device of claim 8, wherein the display and control assembly includes a diver location display operable by the data processor to indicate the relative direction of the other device.

10. The communication device of claim 1, wherein the data processor is calibrated to determine the separation distance in water of a particular salinity.

11. The communication device of claim 1, wherein the transmitter and receiver assembly operates to receive distance signals from a master one of the communication devices on a frequency defined by a communication channel differing from the communication channel of the communication device.

12. The communication device of claim 11, wherein the transmitter and receiver assembly is operable to transmit communication signals to the other device and to the master communication device.

13. The communication device of claim 12, wherein the communication signals are transmitted concurrently.

14. The communication device of claim 12, wherein the data processor includes memory for storing the communication signals and sequentially displaying a text message based on the stored communication signals on the display.

15. The communication device of claim 1, wherein the separation distance determination further comprises processing results of the timing to determine the separation distance and wherein the timing of the received distance signals comprises:

transmitting from the transmitter and receiver assembly a first one of the distance signals;

substantially concurrently with the transmitting, starting a timer;

receiving with the transmitter and receiver assembly a second one of the distance signals from the other one of the communication devices; and substantially concurrently with the receiving, stopping the timer; and determining an elapsed time since the transmitting of the first one of the distance signals.

16. The communication device of claim 1, wherein the distance signals comprise sound waves.

17. A method for providing an alert when a distance between two devices exceeds a distance, the method comprising:

first and second devices each discovering a distance between the first and second devices;

the first device comparing the discovered distance to a first distance condition and alarming when the first distance condition is met by the discovered distance; and the second device comparing the discovered distance to a second distance condition and alarming when the second distance condition is met by the discovered distance;

wherein the discovering the distance includes:

the first device generating a first signal having an initial signal strength and the second device generating a second signal having an initial signal strength, the signal strength of the first and second signals diminishing as the first and second signals travel between the first device and the second device;

the second device receiving the first signal and the first device receiving the second signal;

the second device measuring the signal strength of the received first signal and the first device measuring the signal strength of the received second signal; and the second device discovering the distance from the measured first signal strength and the first device discovering the distance from the measured second signal strength.

18. The method of claim 17 wherein discovering the distance from the measured signal strength includes calculating the distance from the measured signal strength and wherein the calculating is performed based on a salinity value for water in which the two devices are used.

19. The method of claim 17 wherein discovering the distance from the measured signal strength includes comparing the measured signal strength to values in a table to discover the distance.

20. The method of claim 17 wherein alarming includes generating a visible indication.

21. The method of claim 17 wherein alarming includes generating an audible indication.

22. A system for providing an alert when a distance between two devices exceeds a distance, the system comprising a first device and a second device, each device having:

means for discovering a distance between the first and the second device;

means for comparing the distance to a distance condition; and means for alarming when the distance condition is met by the discovered distance;

wherein the means for discovering the distance includes:

the first device having means for discovering the location of the first device;

the second device having means for discovering the location of the second device;

the first device having means for transmitting the location of the first device to the second device and the second device having means for transmitting the location of the second device to the first device; and the first and second devices each having means for comparing the location of the first device to the location of the second device to discover the distance between the first device and the second device.

23. The system of claim 22, wherein the means for alarming includes means for generating a visible indication.

24. The system of claim 22, wherein the means for alarming includes means for generating an audible indication.

25. The system of claim 22, wherein the first device has means for transmitting an alarm signal to the second device and the second device has means for alarming in response to the alarm signal.

26. The system of claim 25, wherein the first device further includes a user selection device for activating the means for transmitting the alarm signal to the second device.

27. A system for providing an alert when a distance between two devices exceeds a distance, the system comprising a first device and a second device, each device having:

a signal generator;

a signal receiver for receiving a signal from the other of the first and second devices;

means for discovering, from a signal received from the other of the first and second devices, a distance between the first and second devices;

means for comparing the distance to a distance condition; and an alarm for alarming when the distance condition is met by the discovered distance;

wherein the signal generator includes means for generating a signal having an initial signal strength, the signal strength diminishing as the signal travels between the first device and the second device and wherein the means for discovering the distance includes means for measuring the signal strength of the received signal and means for discovering the distance from the measured signal strength.

28. The system of claim 27 wherein the means for discovering the distance from the measured signal strength includes means for calculating the distance from the measured signal strength.

29. The system of claim 27 wherein the means for discovering the distance from the measured signal strength includes:

a table having values indicative of signal strength cross-referenced with values indicative of distance; and means for comparing the measured signal strength to values in the table to discover the distance.

30. The system of claim 27 wherein:

the first device further includes means for discovering the location of the first device;

the second device further includes means for discovering the location of the second device;

the signal generator of the first device includes means for generating a signal indicative of the location of the first device and the signal generator of the second device includes means for generating a signal indicative of the location of the second device; and the means for discovering the distance includes means for comparing the location of the first device to the location of the second device to discover the distance between the first device and the second device.

31. The system of claim 27 wherein the means for alarming includes means for generating a visible signal indication.

32. The system of claim 27 wherein the means for alarming includes means for generating an audible indication.

33. The system of claim 27 wherein the first device has means for transmitting an alarm signal to the second device and the second device has means for alarming in response to the alarm signal.

34. The system of claim 33 wherein the first device further includes a user selection device for activating the means for transmitting the alarm signal to the second device.

35. A device for use by a scuba diver in communicating underwater with two or more other scuba divers, comprising:

a first receiver receiving a location signal from a second one of the devices spaced apart a first distance from the device;

a second receiver receiving a location signal from a third one of the devices spaced apart a second distance from the device;

a data processor for processing the location signals to determine the first and second distances, for determining when the first and second distances exceed first and second safety distances respectively, and when either of the determined first and second distances exceeds the safety distances, initiating an alarm; and a display assembly operable by the data processor for indicating the alarm.

36. The device of claim 35, wherein the first and second receivers operate substantially concurrently to receive the location signals.

37. The device of claim 35, wherein the first and second location signals are received on a first and a second frequency, respectively and wherein the first and the second frequencies differ.

38. The device of claim 35, further including a transmitter assembly for transmitting a communication signal to the second one of the devices and for transmitting a communication signal to the third one of the devices.

39. The device of claim 38, wherein the communication signals are transmitted concurrently using a first and a second communication channel frequency, the first communication channel frequency being different from the second communication channel frequency.

40. The device of claim 35, wherein the display assembly includes a separation distance display for displaying at least one of the determined first and second distances.

41. A dive master communication device for use by a dive master in communicating underwater with two or more other scuba divers in one or more dive groups, comprising:

a receiver receiving a distance signal from a first communication device, associated with a first dive group, spaced apart a first distance from the dive master communication device and receiving a distance signal from a second communication device associated with the first dive group spaced apart a second distance from the dive master communication device; and a data processor for processing the distance signals to determine the first and second distances, for determining when the first and second distances exceed a first safety distance, and when either of the determined first and second distances exceeds the first safety distance, initiating an alarm.

42. The device of claim 41, wherein the receiver is further adapted for:

receiving a distance signal from a third communication device, associated with a second dive group, spaced apart a third distance from the dive master communication device; and receiving a distance signal from a fourth communication device associated with the second dive group spaced apart a fourth distance from the dive master communication device; and wherein the data processor processes the distance signals to determine the third and fourth distances, for determining when the third and fourth distances exceed a second safety distance, and when either of the determined third and fourth distances exceeds the second safety distance, initiating an alarm.

43. The device of claim 42, wherein the first safety distance differs from the second safety distance.

44. The device of claim 41, further comprising a display and control assembly displaying the alarm, wherein the display and control assembly includes a setting input device operable by the dive master to set the safety distance.

45. The device of claim 44, wherein the display and control assembly includes a text message display and wherein the data processor operates the display and control assembly to display a text message based on the received distance signals.

46. The device of claim 44, wherein the first and second receiver are adapted for receiving communication signals including a panic signal from the communication devices, wherein the text message indicates the received message was a panic signal.

47. The device of claim 46, wherein the received communication signals include a check diver signal and the text message displayed indicates the received message was a check diver signal.

48. The device of claim 41, wherein the data processor is calibrated to determine the distances in water of a particular salinity or of a particular depth.

49. The device of claim 41, wherein the distance signals are received substantially concurrently.

50. The device of claim 41, wherein the data processor includes memory for storing the distance signals and sequentially displaying a text message based signals on a display.

51. A dive communication system, comprising:

a first diver communication device;

a second diver communication device, wherein each of the first and second communication devices comprises:

a transmitter and receiver assembly transmitting distance signals to and receiving distance signals from the other one of the diver communication devices;

a data processor processing the received distance signals to determine a first separation distance between the communication device and the other device and for comparing the first separation distance to a first safety distance; and a display and control assembly including a display for indicating the safety distance of the communication device and for indicating when the data processor determines the separation distance exceeds the first safety distance; and a dive master communication device, comprising:

a receiver receiving a distance signal from the first diver communication device spaced apart a second distance from the dive master communication device and receiving a distance signal from the second diver communication device spaced apart a third distance from the dive master communication device; and a data processor for processing the distance signals to determine the second and third distances, for determining when the second and third distances exceed a second safety distance, and when either of the determined second and third distances exceeds the second safety distance, initiating an alarm.

52. The system of claim 51, wherein the distance signals comprise sound waves and wherein the first safety distance differs from the second safety distance.

* * * * *